US009726464B2

(12) United States Patent
Moberg

(10) Patent No.: US 9,726,464 B2
(45) Date of Patent: Aug. 8, 2017

(54) PROJECTILE ARRESTING MODULE AND PROJECTILE ARRESTING ARRANGEMENT

(71) Applicant: Stapp International AB, Eskilstuna (SE)

(72) Inventor: Gerth Moberg, Eskilstuna (SE)

(73) Assignee: Stapp International AB, Eskilstuna (SE)

( * ) Notice: Subject to any disclaimer, the term of this patent is extended or adjusted under 35 U.S.C. 154(b) by 287 days.

(21) Appl. No.: 14/438,082

(22) PCT Filed: Oct. 23, 2013

(86) PCT No.: PCT/SE2013/051238

§ 371 (c)(1),
(2) Date: Apr. 23, 2015

(87) PCT Pub. No.: WO2014/065749

PCT Pub. Date: May 1, 2014

(65) Prior Publication Data

US 2015/0260488 A1 Sep. 17, 2015

(30) Foreign Application Priority Data

Oct. 26, 2012 (SE) ..... 1251210

(51) Int. Cl.
*F41J 13/00* (2009.01)
*F41J 13/02* (2009.01)

(52) U.S. Cl.
CPC ..... *F41J 13/00* (2013.01); *F41J 13/02* (2013.01)

(58) Field of Classification Search
CPC ..... F41J 13/00; F41J 13/02
USPC ..... 273/403–410
See application file for complete search history.

(56) References Cited

U.S. PATENT DOCUMENTS 1,363,677 A 12/1920 Serra
3,512,778 A 5/1970 Allen
4,445,693 A * 5/1984 Angwin ..... F41J 13/00 273/404

(Continued)

FOREIGN PATENT DOCUMENTS

DE 2839509 A1 4/1980
DE 3734439 A1 4/1989

(Continued)

OTHER PUBLICATIONS

Supplemental European Search Report completed May 23, 2016 for European Application No. EP 13 84 9185.
International Search Report mailed Feb. 14, 2014 for International Application No. PCT/SE2013/051238.

(Continued)

*Primary Examiner* — Mark Graham
(74) *Attorney, Agent, or Firm* — Brinks Gilson & Lione

(57) ABSTRACT

The invention shows a projectile arresting module (1) comprising a base frame (3), partition walls (9), stopping material (11) positioned between the partition walls (9) and a pressure resisting wall (19). The pressure resisting wall (19) comprises a tight row (25, 27) of vertical hollow sections (15). The inventions also shows a projectile arresting arrangement (100, 200, 300) comprising at least two projectile arresting modules (1), which at least two projectile arresting modules (1) are grouped together, thereby forming an I-shape, L-shape, U-shape, C-shape, F-shape, T-shape or E-shape.

17 Claims, 8 Drawing Sheets

(56) References Cited

U.S. PATENT DOCUMENTS

| | | | | | |
|---|---|---|---|---|---|
| 4,856,791 | A * | 8/1989 | McQuade | F41J 13/00 | 273/410 |
| 5,366,105 | A * | 11/1994 | Kerman | F41J 13/00 | 220/62.11 |
| 5,435,571 | A * | 7/1995 | Wojcinski | F41J 13/00 | 273/404 |
| 5,618,044 | A | 4/1997 | Bateman | | |
| 6,173,956 | B1 | 1/2001 | O'Neal | | |
| 6,341,708 | B1 * | 1/2002 | Palley | B65D 88/14 | 206/3 |
| 6,722,195 | B2 * | 4/2004 | Duke | F41J 13/00 | 273/410 |
| 2002/0121741 | A1 * | 9/2002 | Malone | F41J 13/00 | 273/410 |
| 2006/0131813 | A1 | 6/2006 | Moberg | | |
| 2006/0202425 | A1 * | 9/2006 | Pulkrabek | F41J 3/0004 | 273/404 |
| 2012/0038110 | A1 * | 2/2012 | Priebe | F41J 13/00 | 273/410 |
| 2016/0116260 | A1 * | 4/2016 | Oh | F41J 13/00 | 273/410 |

FOREIGN PATENT DOCUMENTS

| | | | | |
|---|---|---|---|---|
| DE | 94 07 238 | U1 | 7/1994 | |
| DE | 20 2005 002 672 | U1 | 6/2005 | |
| EP | 0332273 | A1 | 9/1989 | |
| EP | 0683375 | A1 | 11/1995 | |
| EP | 1 990 599 | A1 | 11/2008 | |
| GB | 2042142 | A * | 9/1980 | F41J 13/00 |
| JP | 2002 318097 | A1 | 10/2002 | |
| JP | 2006 078109 | A | 3/2006 | |
| JP | 2006 343082 | A | 12/2006 | |
| SE | 1251210 | A1 | 5/2014 | |

OTHER PUBLICATIONS

Written Opinion mailed Feb. 14, 2014 for International Application No. PCT/SE2013/051238.

* cited by examiner

PROJECTILE ARRESTING MODULE AND PROJECTILE ARRESTING ARRANGEMENT

This application claims the benefit under 35 U.S.C. §371 of International Application No. PCT/SE2013/051238, filed Oct. 23, 2013, which claims the benefit of Swedish Patent Application No. 1251210-9, filed Oct. 26, 2012 which are incorporated by reference herein in their entirety.

TECHNICAL FIELD

The present invention relates to a projectile arresting module according to the preamble of claim 1. The invention also relates to a projectile arresting arrangement according to the preamble of claim 14. The projectile arresting module and the projectile arresting arrangement relates to installations at shooting ranges.

BACKGROUND ART

During practice and competition shooting with powder-propelled projectiles at shooting ranges, the shots are aimed at target areas e.g. in the shape of ring-marked square targets or figure-like targets of various sizes and shapes. Behind the targets there is generally a projectile arrester.

The outdoor type arrester generally consists of ground masses or gravel being dozed into an elongated bank, or as an alternative, the arrester is a natural slope. The extension of the arrester is determined by the target area, and beyond that, by the regulated safety distances for the type of fire arms used and the manner of shooting. To avoid ricochets from the arresting material in e.g. arresting banks, these are supplemented by projectile-arresting material on the section of the arrester being shot at. Such a material is carefully selected for the type of shooting and will arrest the projectiles and keep them inside the arrester.

More sophisticated projectile arresters comprise a frame of walls surrounding a bed of granular material, with a rubber front layer. EP0683375 A1 shows an absorption projectile arrester of the type insertable within a container. All the walls, except the wall faced toward the shooters, are made up of ballistic sheet. The surface of the projectile arrester faced toward the shooters is made up of a rubber shield. Granular material is provided behind the shield. Means for sustaining the thrust of the granular material are provided between said granular material and said shield. These means comprises hardened steel or rubber vertical elements. Alternatively the sustaining means comprises a plurality of blocks realized by plastic material and having a very high ductability. The blocks can also be realized using pressed and glued elastomeric granular material. A layer allowing the passage of the undeformed projectiles is provided. Said layer does not tear or permanently deform after the passage of the projectiles.

The projectile arrester disclosed in EP0683375 is intended for indoor use. Therefore the construction is not adapted for outdoor use. The height of the arrester is too low for outdoor shooting, since outdoor shooting distances are generally longer than indoor shooting distances. A further disadvantage with the projectile arrester disclosed in EP0683375 is that the means for sustaining the thrust of the granular material will tear and deform during penetration.

US2006/0131813 shows an apparatus for installation at shooting ranges. The apparatus has a housing, which housing has an L-shaped concrete slab, a resilient top layer and a flexible bottom layer. The bottom layer extends along an inclined bottom surface and over an upwardly protruding support member to a front side. The top layer is attached to the bottom layer at the front side to form a container. A non-flowable granulate material is packed in the container. The inclined bottom surface is inclined at an angle relative to a horizontal plane. The angle is less than an angle of repose of the granulated material.

The apparatus shown in US2006/0131813 is intended for outdoor use. It has the disadvantage that it is so large and heavy that it cannot be moved to another area. If once installed it has to remain there. Additionally the apparatus has the disadvantages that the rubber front layer will be teared and deformed during penetration of the projectiles. This depends on the massive rubber material which is pushed aside and backwards by the penetrating projectile. The rubber front layer also tends to assume a bulged form after the penetration.

There is thus a need for an improved projectile arrester removing the above mentioned disadvantages.

SUMMARY

The object of the present invention is to provide an inventive projectile arresting module where the previously mentioned problems are avoided.

This object is achieved by a projectile arresting module comprising a base frame forming a floor and a back wall of the projectile arresting module, partition walls extending in a direction substantially perpendicular to the back wall, the partition walls comprising a back edge attached to the base frame and a front edge. The projectile arresting module further comprises stopping material positioned between the partition walls, and a pressure resisting wall comprising horizontal support elements attached to the front edge of the partition walls and a tight row of vertical hollow sections connected to the horizontal support elements.

The projectile arresting module has the advantage that only the hollow sections which have a large number of penetrations need to be replaced during maintenance. The hollow sections which are more or less intact can remain.

Another advantage is that the row of hollow sections is resistant to the load from the stopping material.

Yet another advantage is that projectiles penetrating a hollow section expand by the stopping material so that the projectiles will be captured between the row of hollow sections and the back wall.

Yet a further advantage of the present invention is that the hollow sections don't deform by the penetrating projectiles. In contrast to a massive front layer, no material is pushed aside and backwards by the penetrating projectiles. Thus, even if the hollow sections receive many penetration holes, the hollow sections will still retain their rigidity.

Yet a further advantage of the present invention is that the projectile arrester is a module. By grouping at least two projectile arresting modules together, any desired shape of projectile arresting arrangement can be obtained. The projectile arresting arrangement is also flexible and can easily be rearranged into another form or to another place.

According to another feature the hollow sections are attached to hollow plastic profiles surrounding the horizontal support elements. This has the advantage that the hollow sections are steady and firmly mounted.

According to another feature the hollow sections are provided with a groove and a tongue to connect the hollow sections to each other. This has the advantage that there will be no gaps between the hollow sections. The hollow sections are also easy to install and to remove.

According to another feature the hollow sections are made of a plastic material or of a reinforced plastic material. This has the effect that due to the friction arised during penetration of a projectile, the penetrated plastic material of the hollow sections will melt in the penetrating area. This is advantageous since the hollow sections will not be bent or deformed by the penetrating projectiles, but the physical measures of the projectile will sustain intact as there is not enough force created from the passage of the projectile through the partially melted plastic to press the plastic profile sideways or into the stopping material.

According to another feature the hollow sections have cross section length of 30-50 mm and a cross section width of 100-200 mm, and more preferably a cross section length of 35-45 mm and a cross section width of 115-175 mm. This has the advantage that the hollow sections are rigid enough to withstand the pressure from the stopping material. At the same time the hollow sections are relatively thin, resulting in less material consumption and less costs.

According to another embodiment the projectile arresting module comprises a roof projecting from the back wall and covering an area in front of the projectile arresting module. The roof has the advantage that the projectile arresting module is protected against e.g. rain and snow. The roof has also the advantage that ricochets can be stopped and absorbed by the roof.

According to yet another feature the roof is attached to the base frame and the partition walls. This has the advantage that the roof is steady and firm.

According to yet another feature the roof comprises a roof bottom layer made of a row of hollow sections, and a roof top layer. This has the advantage that projectiles penetrating a hollow section brake into pieces when they hit the roof top layer. The pieces ricochet but are stopped by the hollow sections, since the pieces are not able to escape through the penetrating holes in the hollow sections.

According to yet another feature the roof top layer is made of a ballistic steel plate. This has the advantage that projectiles penetrating a hollow section are unable to proceed further through the roof.

According to a further feature there is a space between the roof bottom layer and the roof top layer. This has the advantage that there will be room for the captured projectiles.

According to a further feature there the space between the roof bottom layer and the roof top layer is 50 mm-300 mm, and preferably 100 mm. The advantage with the spacing is that there is enough space to handle the pressure that is created from the projectile hitting the roof top layer and also reduce the tearing on the back side of the hollow sections from shrapnel.

According to a further feature a rubber sheet is mounted on the back side of the horizontal support elements for target projection. This has the advantage that the rubber sheet can be used as a projection screen for simulation of different targets.

According to yet a further feature the base frame is a standard ground support element. This has the advantage that the projectile arresting module will be cheap and that the base element is relatively small and can be positioned anywhere on the ground. The base element can easily be moved to another position when desired.

The object of the present invention is also achieved by a projectile arresting arrangement as being defined in the introduction, the projectile arresting arrangement being characterised by the features claimed in claim 14. This has the advantage that a shooting area can be protected in all directions without the need of any protection walls or similar arrangements. By grouping at least two projectile arresting modules together, any desired shape can be obtained of projectile arresting arrangement. The projectile arresting arrangement is also flexible can easily be rearranged into another form or easily be moved to another place.

BRIEF DESCRIPTION OF THE DRAWINGS

The present invention will now be described in detail with reference to the schematic figures, wherein.

DETAILED DESCRIPTION

Figure 1:
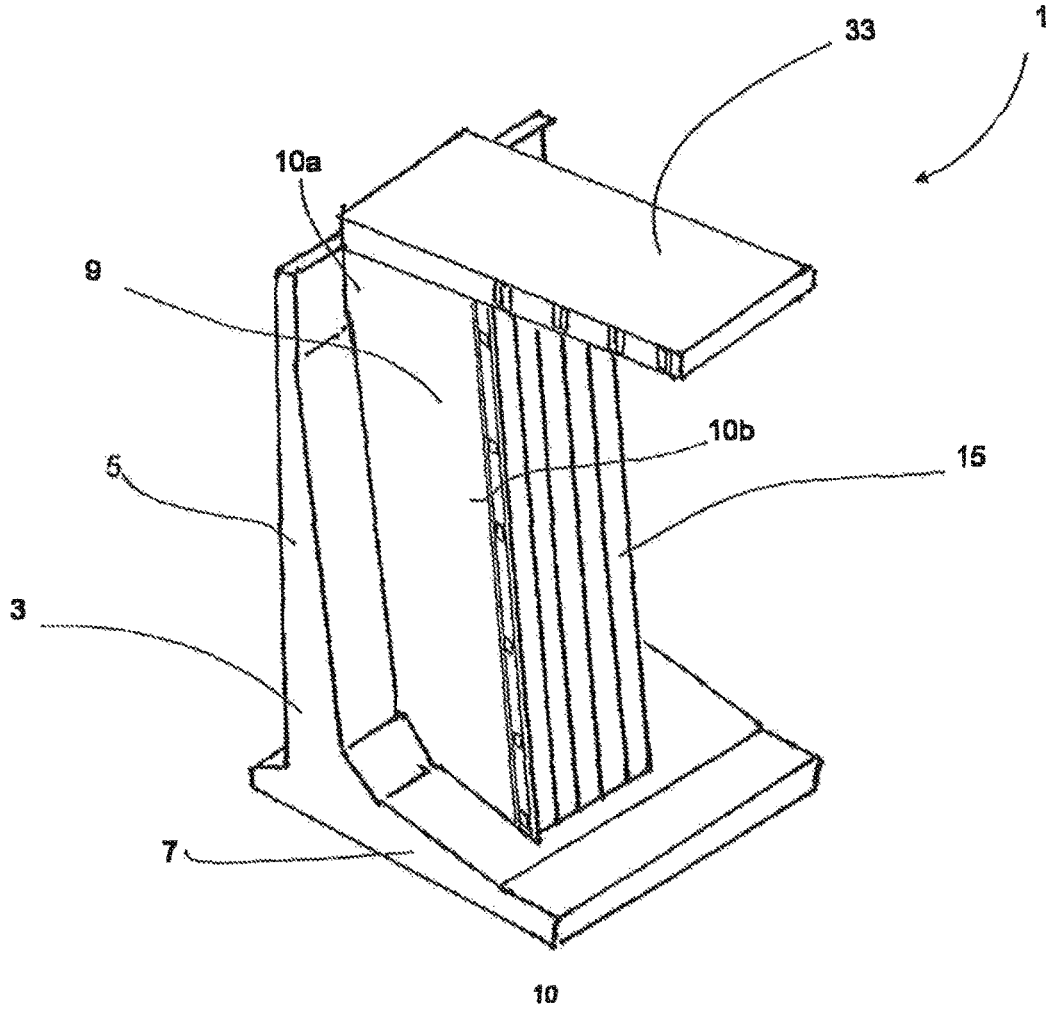
FIG. 1 shows a perspective view of a projectile arresting module according to an embodiment of the present invention.

Hereinafter, embodiments of the present invention will be described in detail with reference to the accompanying drawings related to embodiments, wherein for the sake of clarity and understanding of the invention some details of no importance are not shown in the drawings.

For clarity reasons the figures are not depicted according to scale.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description thereto are to be regarded as illustrative in nature, and not restrictive.

The front side of the projectile arresting module is defined as the side which is directed towards the shooter, and the back side of the projectile arresting module is defined as the side which is opposite to the front side.

Figure 2:
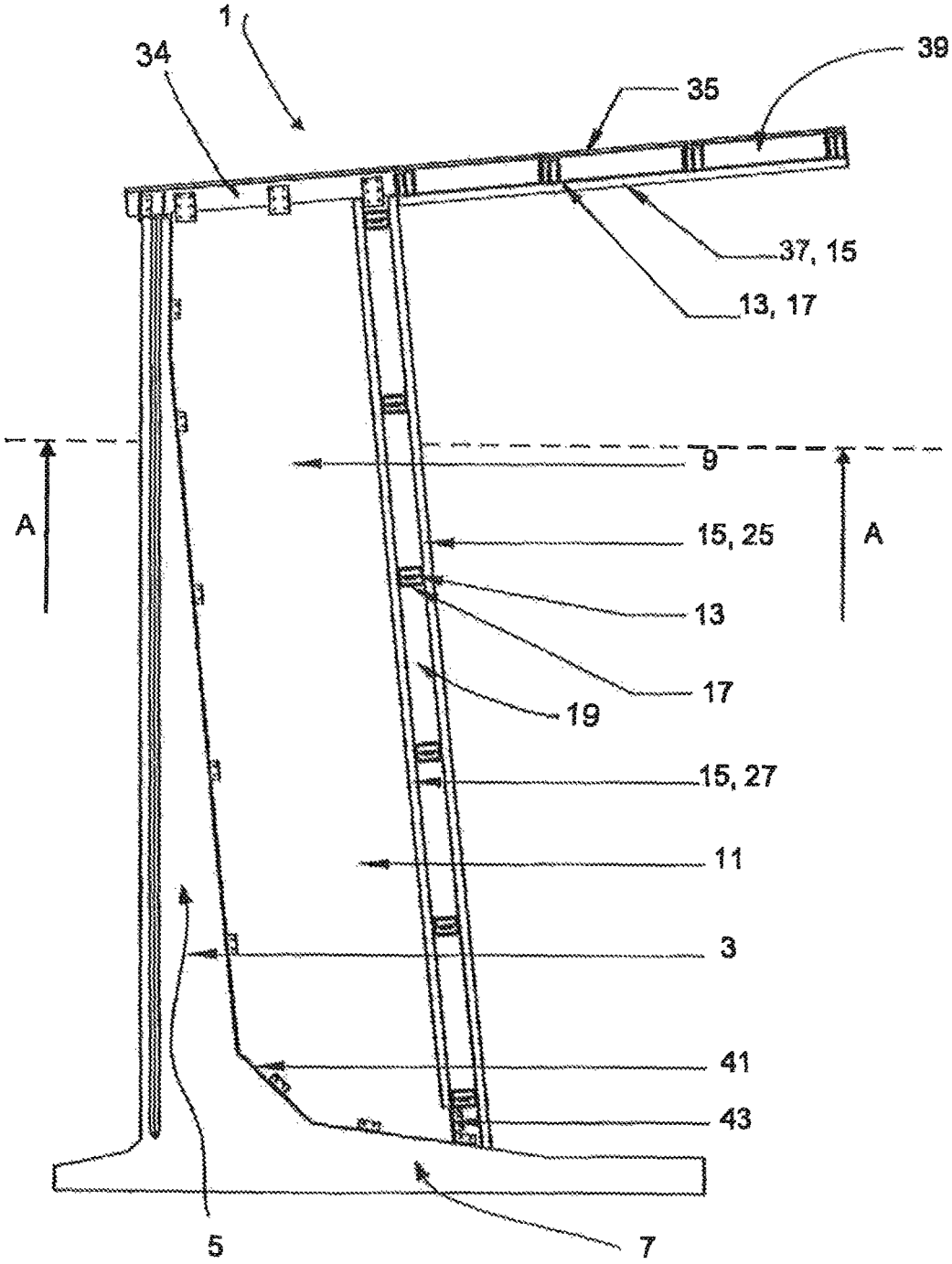
FIG. 2 shows a side view of a projectile arresting module according to an embodiment of the present invention.
Figure 3:
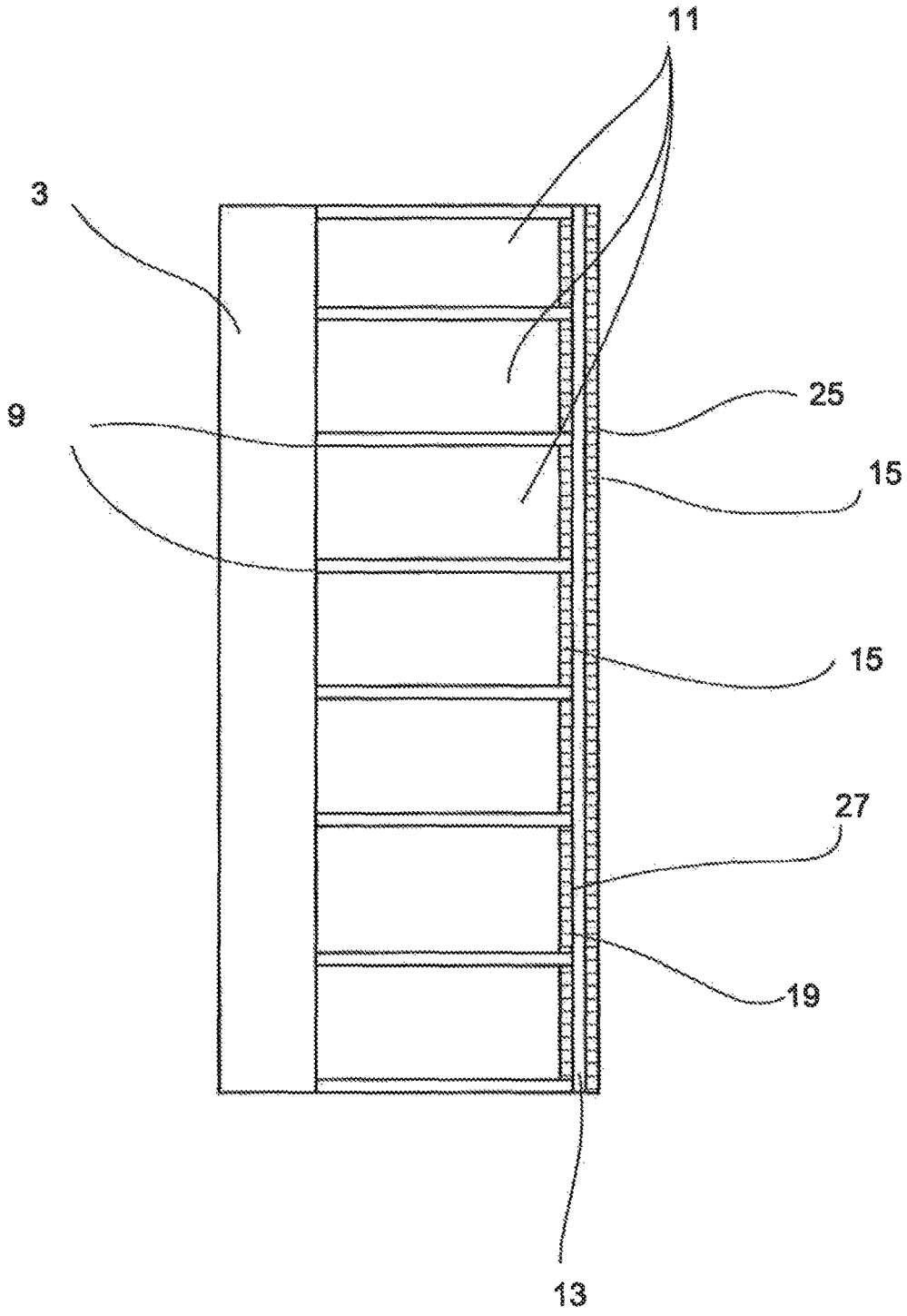
FIG. 3 shows a cross section view of the projectile arresting module according to an embodiment as seen from the cut A-A in FIG. 2.

FIGS. 1 and 2 shows a perspective view and a side view of a projectile arresting module 1 according to an embodiment of the present invention. FIG. 3 shows a cross section view of the projectile arresting module according to the embodiment as seen from the cut A-A in FIG. 2. The projectile arresting module 1 comprises a base frame 3 made of concrete. The base frame 3 may be a standard ground support element such as a precast concrete retaining wall unit in L- or T-shape for larger heights. The base frame 3 forms a back wall 5 and a floor 7 of the projectile arresting module 1. The height of the projectile arresting module 1 may be between 0.6 m-5 m, and preferably between 1.2 m-5 m. Thin partition walls 9 made of ballistic steel plates are attached to the base frame 3 and extend in the direction towards the shooter. The partition walls 9 comprises a back edge 10*a*, which is attached to the base frame 3, and a front edge 10*b*. The distance between the partition walls 9 is preferably about half distance of the precast concrete element width. The partition walls 9 may have a width of about 150 mm-1500 mm, and preferably 500 mm-1000 mm. The projectile arresting module 1 is also provided with a stopping material 11, which functions to arrest and absorb the projectiles. The stopping material 11 is preferably a plastic or rubber granular material but other materials capable of arresting and keeping the projectiles may also be used. The stopping material 11 is positioned between the partition walls 9.

The projectile arresting module 1 further comprises a pressure resisting wall 19. The pressure resisting wall 19 serves to resist the pressure from the stopping material 11, to keep the stopping material 11 in place and to prevent projectiles penetrating the projectile arresting module 1 from escaping. The pressure resisting wall 19 comprises horizontal support elements 13 made of e.g. steel plate and mounted on different heights above each other. The horizontal support elements 13 are attached to the partition walls 9 and are preferably mounted with a distance of 0.3 m-2 m between each other, and preferably 0.6 m-1.5 m. The distance between the horizontal support elements 13 depends on the pressure from and the character of the stopping material 11. Each of the horizontal support elements 13 may be covered by a plastic hollow profile 17. The plastic hollow profiles 17 are arranged to prevent projectiles, which are hitting the horizontal support elements 13, from rebounding with a risk of hitting the shooter or other valuable objects.

Figure 4:
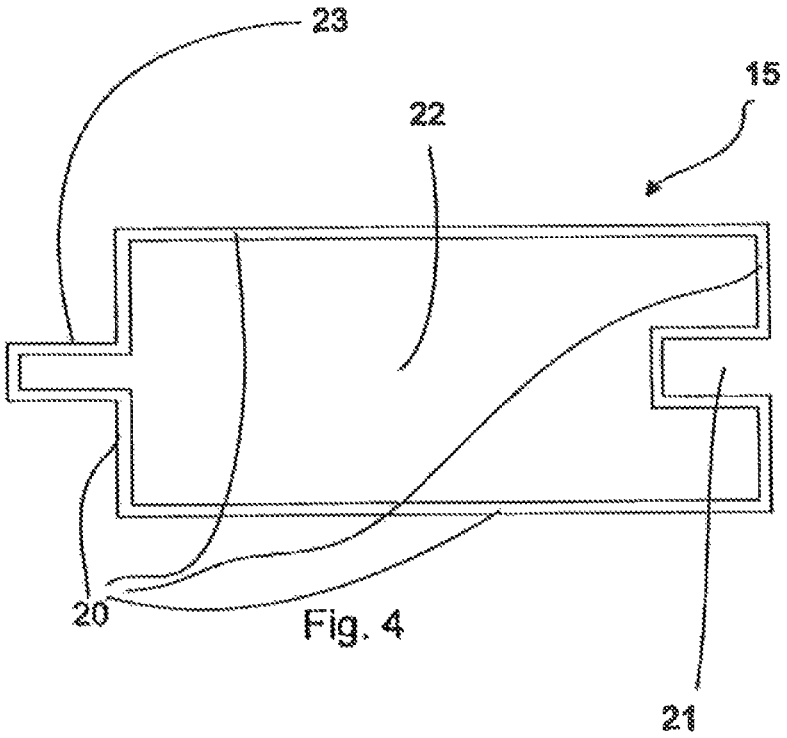
FIG. 4 shows a cross section view of a hollow section.

The pressure resisting wall 19 also comprises vertical hollow sections 15 connected to the horizontal support elements 13. The vertical hollow sections 15 are preferably made of a plastic material or a reinforced plastic material, but can principally be made of any rigid material resisting the load from the stopping material 11 and being penetrable by the projectiles. FIG. 4 shows a cross section view of a plastic hollow section 15. The hollow sections comprise four side elements 20 enclosing an inner space 22. The vertical hollow sections 15 may have a cross section length of 30-50 mm and a cross section width of 100-200 mm. Preferably the vertical hollow sections 15 have a cross section length of about 35-45 mm and a cross section width of 115-125 mm. The vertical hollow sections 15 may have a thickness of 2-6 mm, and more preferably of 3-5 mm. The hollow profiles 15 may also be provided with inner stiffening walls or flanges (not showed).

The vertical hollow sections 15 are connected to the horizontal support elements 13 in a tight row. This means that the hollow sections 15 are positioned adjacent each other so that no openings appear between the hollow sections 15 where stopping material can come out or projectiles can enter. The vertical hollow sections 15 may be provided with a groove 21 and a tongue 23 serving to connecting the vertical hollow sections 15 to each other and to prevent openings.

By making the hollow profiles 17 surrounding the horizontal support elements 13 in a plastic material, the vertical hollow sections 15 may be attached to the hollow profiles 17 by means of plastic expansion-shell anchor bolts. This has the advantage that projectiles hitting the expansion-shell anchor bolts will not rebound.

Figure 5:
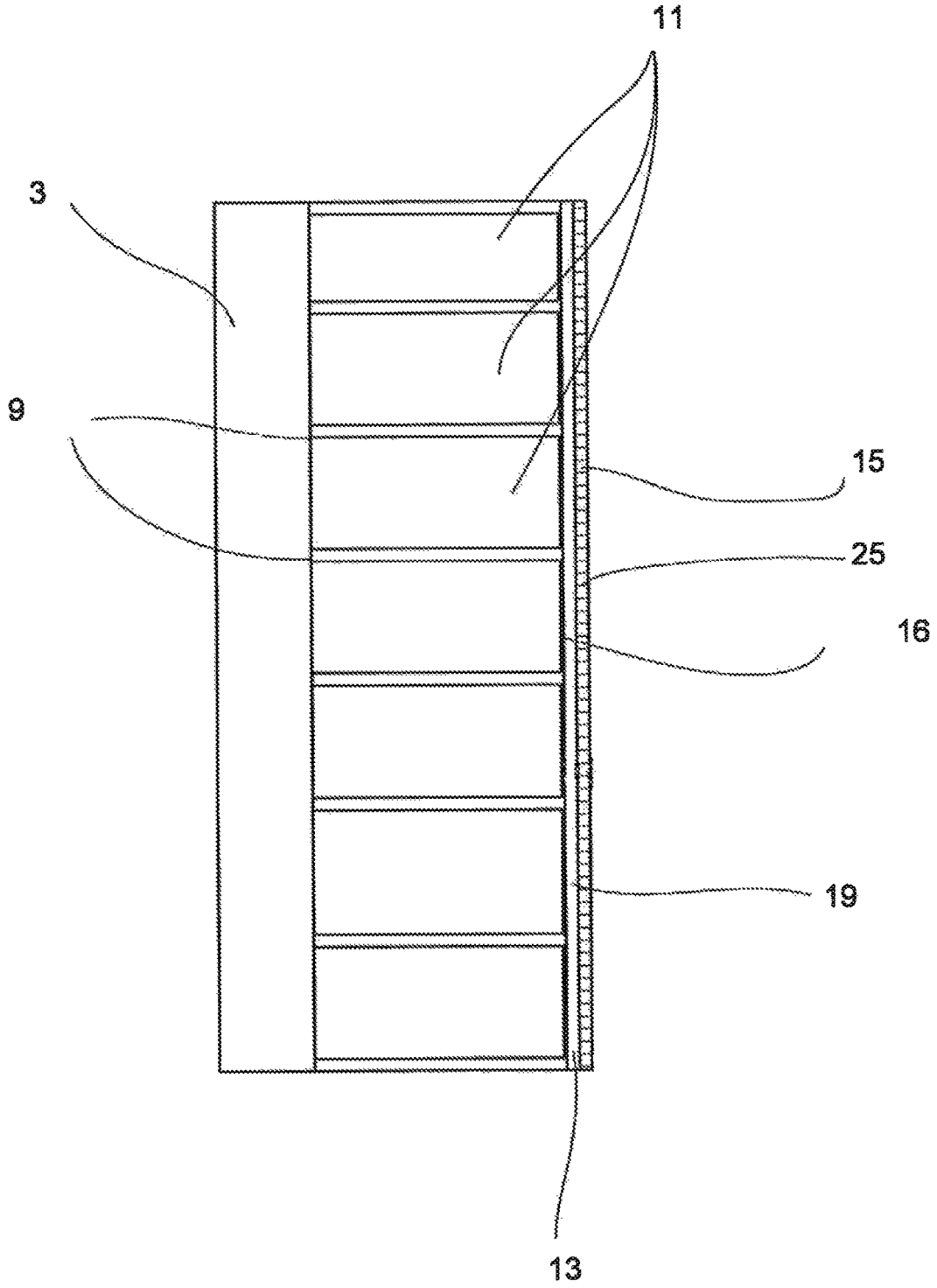
FIG. 5 shows a cross section view of the projectile arresting module according to an embodiment as seen from the cut A-A in FIG. 2.
Figure 6:
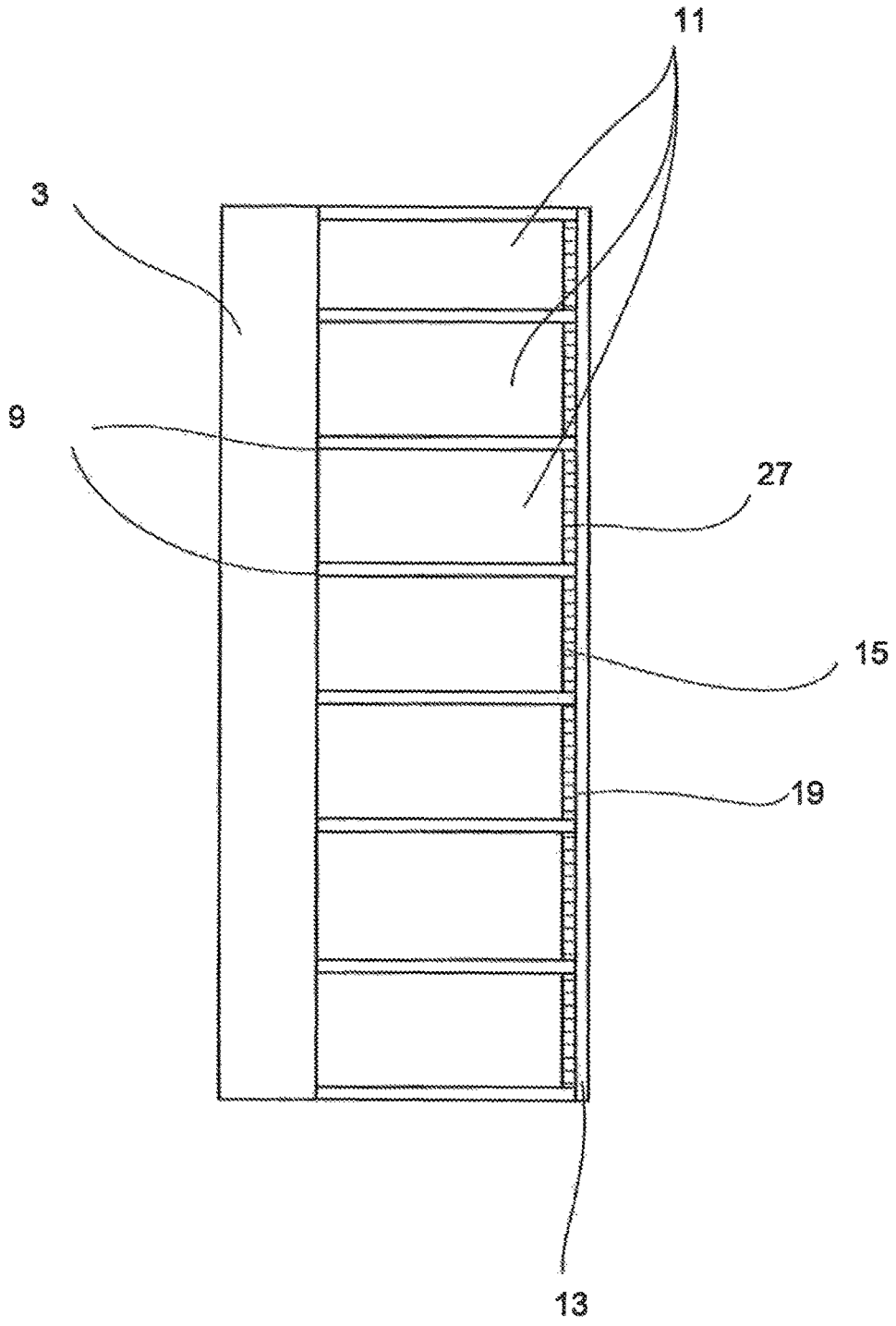
FIG. 6 shows a cross section view of the projectile arresting module according to an embodiment as seen from the cut A-A in FIG. 2.

In the embodiment showed in FIGS. 2 and 3 the pressure resisting wall 19 comprises a first row 25 of vertical hollow sections 15 mounted on the front side of the horizontal support elements 13 and a second row 27 of vertical hollow sections 15 mounted on the back side of the horizontal support elements 13. The second row 27 of vertical hollow sections 15 serves to keep the stopping material 11 in place during maintenance of the projectile arresting module 1, when some or all of the penetrated vertical hollow sections 15 in the first row 25 are removed and replaced by new vertical hollow sections 15. According to another embodiment the second row 27 of vertical hollow sections 15 is replaced by a polymer plate or by a rubber sheet 16. This embodiment is shown in FIG. 5. According to yet another embodiment the first row 25 of vertical hollow section 15 is omitted, meaning that the pressure resisting wall 19 comprises the second row 27 of vertical hollow sections 15 and the horizontal support elements 13. This embodiment is showed in FIG. 6.

The projectile arresting module 1 may be provided with a waterproof sheet 41 of polymer material. This sheet 41 prevents water from the ground from being absorbed by the stopping material 11. The waterproof sheet 41 also stops rain water which has entered the projectile arresting module 1 from leaking into the ground. This prevents unwanted lead and other contaminants from ammunition or stopping material from being leached by water and spread in an uncontrolled manner into the surrounding environment. The sheet 41 is applied on the base frame 3 and may also cover a lower part of an inner side of the back wall 5. The rain water may be collected in a drainage tube positioned in the lower part of the projectile arresting module 1 (not showed). The drainage tube may be provided with a drain opening 43 or a sleeve coupling (not showed) penetrating the sheet 41. Another tube, leading to a collecting vessel or a filter, may be coupled to the sleeve coupling (not showed).

The projectile arresting module 1 may be provided with a roof 33. The roof 33 may attached to the base frame 3 and supported by support beams 34, which are attached to the partition walls 9. The roof 33 may project from the back wall 5 and cover an area in front of the projectile arresting module 1. The aim of the roof 33 is to protect the projectile arresting module 1 and to prevent that misdirected shots pass over the projectile arresting module 1 into the surroundings.

The roof 33 comprises a roof top layer 35 made of ballistic steel plates. It also comprises a roof bottom layer 37 made of a row of hollow sections 15. The hollow sections 15 are similar to the hollow sections forming the front wall 19 and they are mounted in a row in a similar way as the rows 25 and 27. The roof top layer 35 is connected to the support beam 34, and the roof bottom layer 37 is also connected to the support beams 34 by means of horizontal support elements 13, which are covered by a plastic hollow profile 17. As seen from the FIG. 3 there is a space 39 between the roof top layer 35 and the roof bottom layer 37. This space 39 may have a height of about 5-15 cm, and preferably 10 cm.

A misdirected projectile hitting the roof bottom layer 37 with the hollow sections 15 will penetrate a hollow section and expand against the ballistic plate 35. Due to the enlarged size of the projectile, it will be captured within the space 39, without being able to rebound through the penetration hole. The space 39 may also be filled with e.g. a stopping and/or absorbing material.

Figure 7:
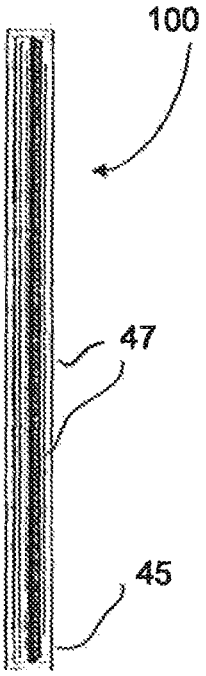
FIG. 7 shows a perspective view of an I-formed projectile arresting arrangement according to an embodiment of the present invention.

FIG. 7 shows a perspective view of a I-formed projectile arresting arrangement 100 according to an embodiment of the present invention. Several projectile arresting modules 1 are positioned in a line adjacent each other, thereby forming an I-formed projectile arresting arrangement 100. The projectile arresting arrangement 100 comprises end modules 45 and intermediate modules 47. The end modules 45 according to this embodiment each have a right angled base frame 3 forming an end corner. The projectile arresting arrangement 100 shown in FIG. 7 comprises 14 intermediate modules 47 and two end modules 45.

Figure 8:
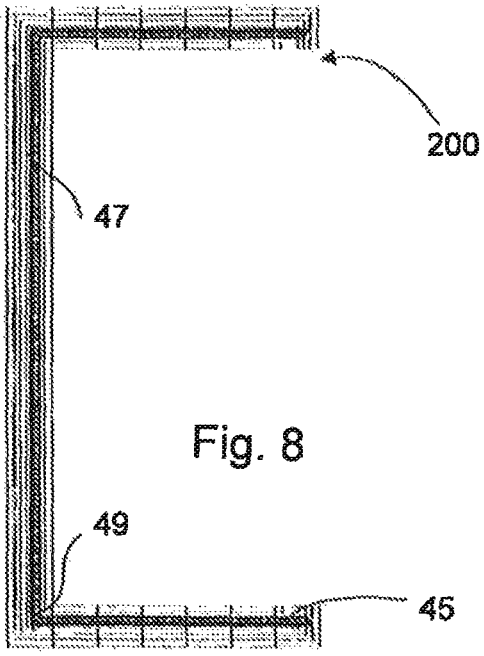
FIG. 8 shows a perspective view of a U-formed projectile arresting arrangement according to an embodiment of the present invention.
Figure 9:
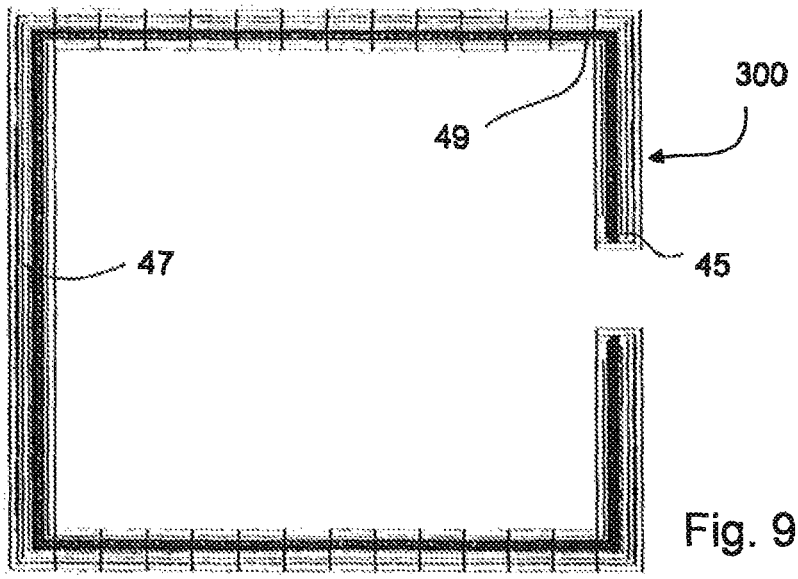
FIG. 9 shows a perspective view of a C-formed projectile arresting arrangement according to an embodiment of the present invention.

The projectile arresting modules 1 may also be grouped together so that they form an L-shaped, U-shaped or C-shaped projectile arresting arrangement 200 and 300 (see FIGS. 8 and 9). The end modules 45 according to this embodiment have a right angled base frame 3. The projectile arresting arrangement 200, 300 according to these embodiments also comprise corner modules 49. The corners modules 49 have a right angled base frame 3, forming corners of the projectile arresting arrangement 200, 300.

Further shapes of the projectile arresting arrangement 100, 200, 300 can be obtained by positioning projectile arresting modules 1 adjacent each other, such as e.g. E-shape, F-shape or T-shape.

It is not necessary to provide the end modules 45 with a right angled base frame 3. Principally the end modules 45 may have a construction which is similar to the intermediate modules 47.

Figure 10:
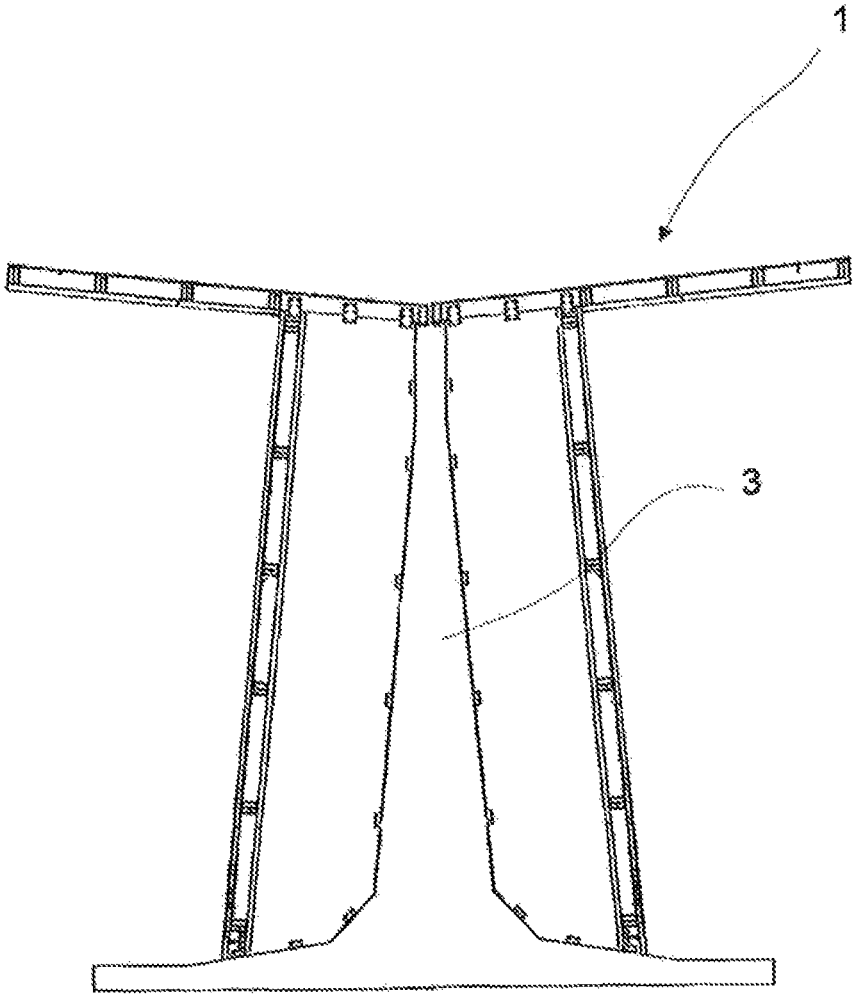
FIG. 10 shows a side view of a projectile arresting module according to an embodiment of the present invention.

According to a further embodiment the projectile arresting module 1 is reversed. This means that the base frame 3, instead of having a form of an upright L with a front side and a back side, has the form of an upside-down T, with two front sides and no back side. This embodiment is shown in FIG. 10. As seen in this figure the projectile arresting module 1 is symmetrical about the back wall 5 of the base frame 3. This embodiment has the advantage that the projectile arresting modules 1 may be grouped into apartment systems where shooting can be performed on both sides of the respective projectile arresting modules 1.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims.

The invention claimed is:

1. A projectile arresting module comprising:

a base frame forming a floor and a back wall of the projectile arresting module, partition walls extending in a direction substantially perpendicular to the back wall, the partition walls comprising a back edge attached to the base frame, and a front edge, stopping material positioned between the partition walls, and a pressure resisting wall comprising horizontal support elements attached to the front edge of the partition walls, and a tight row of vertical hollow sections connected to the horizontal support elements.

2. The projectile arresting module according to claim 1, wherein the vertical hollow sections are attached to hollow plastic profiles surrounding the horizontal support elements.

3. The projectile arresting module according to claim 1, wherein the vertical hollow sections are provided with a groove and a tongue to connect the vertical hollow sections to each other.

4. The projectile arresting module according to claim 1, wherein the vertical hollow sections comprise a plastic material.

5. The projectile arresting module according to claim 1, wherein the vertical hollow sections have a cross section length of 30-50 mm and a cross section width of 100-200 mm.

6. The projectile arresting module according to claim 1, wherein the projectile arresting module comprises a roof projecting from the back wall and covering an area in front of the projectile arresting module.

7. The projectile arresting module according to claim 6, wherein the roof is attached to the base frame and the partition walls.

8. The projectile arresting module according to claim 7, wherein the roof comprises a roof bottom layer made of a row of hollow sections, and a roof top layer.

9. The projectile arresting module according to claim 8, wherein the roof top layer comprises a ballistic steel plate.

10. The projectile arresting module according to claim 8, further comprising a space between the roof bottom layer and the roof top layer.

11. The projectile arresting module according to claim 10, wherein the space has a height of 50-300 mm.

12. The projectile arresting module according to claim 1, wherein the base frame is a standard ground support element.

13. A projectile arresting arrangement comprising at least two projectile arresting modules in accordance with claim 1, which at least two projectile arresting modules are grouped together, thereby forming an I-shape, L-shape, U-shape, C-shape, F-shape, T-shape or E-shape.

14. The projectile arresting module according to claim 4, wherein the plastic material comprises a reinforced plastic material.

15. The projectile arresting module according to claim 1, wherein the vertical hollow sections have a cross section length of 35-45 mm and a cross section width of 115-125.

16. The projectile arresting module according to claim 10, wherein the space has a height of 100 mm.

17. The projectile arresting module according to claim 1, wherein the base frame is a standard ground support element comprising a precast concrete retaining wall unit.

* * * * *